United States Patent [19]

Rodgers

[11] 3,999,712

[45] Dec. 28, 1976

[54] FLUID SPRAY NOZZLE

[76] Inventor: J. Linn Rodgers, 9606 LaSerna Drive, Whittier, Calif. 90605

[22] Filed: July 7, 1975

[21] Appl. No.: 593,681

[52] U.S. Cl. ..... 239/276; 16/149

[51] Int. Cl.[2] ..... B05B 15/06

[58] Field of Search ..... 239/276, 567; 220/337, 220/338; 403/52, 65, 119; 16/DIG. 13, 171, 149, 150, 192

[56] References Cited

UNITED STATES PATENTS

| | | | |
|---|---|---|---|
| 621,514 | 3/1899 | Armitstead | 239/276 X |
| 1,058,189 | 4/1913 | McBoyle | 239/276 X |
| 1,566,232 | 12/1925 | Schreiter | 239/276 X |
| 2,960,254 | 11/1960 | Kiba | 220/338 |
| 3,328,831 | 7/1967 | Fiore, Jr. | 220/338 X |
| 3,497,908 | 3/1970 | Zamarra | 220/338 X |

*Primary Examiner*—John J. Love

*Attorney, Agent, or Firm*—D. Gordon Angus; Donald D. Mon

[57] ABSTRACT

A spray nozzle adapted for attachment to a hose for spraying water on a garden or lawn has a neck which merges into an enlarged delivery region, at the front of which there is a spray plate containing holes through which the fluid sprays. A pin for insertion into the ground is formed in the shape of an open eye at one end, the eye being attached by forcing it between juxtaposed bosses protruding toward each other from lugs at the under side of the nozzle device. The part of the device comprising the neck and delivery region is made in one piece of molded material and the spray member containing the spray plate is made separately of a similar molded material, these two parts then being attached together. To permit the making of the spray member portion in a mold, the mold is constructed so that it parts at a plane passing through the parts of the protruding bosses which are closest to each other, so that the mold parts can be separated from the cast article.

2 Claims, 7 Drawing Figures

24
2
15
38
22
25
23
7
7
36
22a
23a
21
17
14
2
18
37
26
27
10
39
4
4
11
32
33

17
16
20
15
23
19
14
36
23a
25

15
23
36

34
35
32
33
13
12
11

22
25
36
23
24
28
22
23
28
32
33
29

16
18
20

31
30
28
29

FLUID SPRAY NOZZLE

This invention relates to fluid spray nozzles of a type commonly used for spraying water on a lawn or garden.

Such a spray device has commonly comprised a rear portion for attachment to a hose and an enlarged or widened forward portion covered by a perforated forward plate through which water is sprayed. For the purpose of positioning the spray device from place to place as may be desired, the spray device has commonly been provided with a pivotable pin which can be stuck into the ground to raise the forward end of the spray above the ground at a desired angle. In such prior devices the pin has commonly been made pivotable by drilling a hole through it and through a corresponding part of the spray device so that a pivot pin or a threaded screw can be passed through these holes; and the screw may be tightened by a wing nut. Such spray devices have commonly been made of molded plastic. Significant items of cost of such devices has resided in the hole-drilling operation and the pivot pin, or screw with nut, and the need for using relatively expensive non-corrodible parts at the pivot. Because of the corrosion factor it has become common to use a relatively expensive pin.

An object of this invention is to provide a spray device which is simple in construction relative to prior known spray devices.

A related object is to provide such a spray device which is inexpensive relative to prior known spray devices.

In accordance with the present invention it is possible to make a spray device which is simpler and more economical to construct, than heretofore. This is accomplished by avoiding the drilling operation and the use of a pivot pin, screw or wing nut and also the relatively expensive type of pin to be stuck into the ground.

The invention is carried out by providing a pin (herein sometimes referred to as a stick pin) to be stuck in the ground, which is curled at one end to form an eye. For the purpose of holding this stick pin by means of its eye in pivotal relationship to the spray device, the spray device is provided with lug means with surfaces having juxtaposed bosses spaced apart from each other so that the eye portion of the pin can be forced between the bosses by straining them apart from each other so that when the bosses become positioned at the eye from opposite sides of the eye, the bosses return to their normal positions permitting at least part of the bosses to enter into the eye to hold the eye to the bosses in pivotal relationship.

According to a feature of the invention, the spray member at the front of the spray device is formed separately from the remainder of the spray device and then the two formed parts of the spray device are attached together as by cementing. These spray device parts are preferably formed by molding. To permit molding of the spray member formed with the juxtaposed bosses, the molding is done by use of a mold which separates at a plane passing through the locations of the bosses which are closest to each other.

The foregoing and other features of the invention will be better understood from the following detailed description and the accompanying drawing of which:

Figure 2:
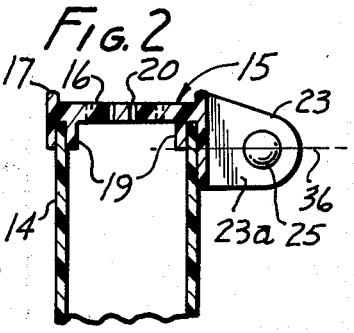
FIG. 2 is a cross-section view of part of the nozzle of FIG. 1 taken at line 2—2 of FIG. 1.
Figure 3:
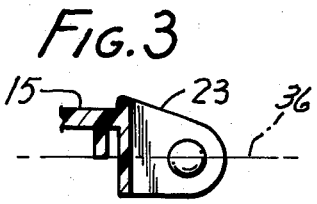
FIG. 3 shows in cross section a part of the spray nozzle shown in FIGS. 1 and 2.
Figure 4:
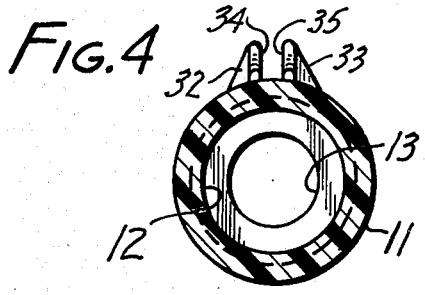
FIG. 4 is a cross-section view taken at line 4—4 of FIG. 1.

Referring to the drawing, the nozzle comprises a neck section 10 which may be substantially cylindrical in shape, havat its inlet end a throat 11 which is preferably also substantially cylindrical and provided with internal threads 12 for fitting it to a fluid supply conduit, which is ordinarily a water line or hose. Forward (in the direction of fluid flow) of the threaded portion 12 there is an internal flange against which a suitable washer 13 is placed, the flange being concealed by the washer in FIG. 4. Forward of the next portion 10, the nozzle flares outwardly to form an enlarged fluid delivery section 14 whose width at the forward end is substantially greater than its depth, the depth, best seen in FIGS. 2 and 7, being approximately the same as the diameter at the neck 10.

A spray member 15 is fitted over the forward end of the delivery region 14. The spray member comprises a front plate 16 having a circumferential rim or band 17 around it and extending rearwardly so that this band fits over the forward rim 18 of the delivery region 14. There extends rearwardly from plate 16 another band 19 spaced inside of the band 17 by the proper distance so that the rim 18 of the fluid delivery region fits into the space between bands 17 and 19 and abuts the back of face 16. The plate 16 is perforated by numerous holes 20 through which the fluid sprays in a well known manner. At the under side of band 17 and at a central position relative to the extreme width of spray member 15, this band 17 is enlarged at 21 to extend to a somewhat more rearward position than the remainder of band 17. At this region of band 17 there are formed two spaced lugs 22 and 23 which extend downwardly from the band 17. The inner facing side walls **22*a* and 23*a* of these respective lugs each has a raised boss 24 and 25** respectively, these bosses being juxtaposed and protruding toward each other with a space therebetween.

Spray member 15 is fastened to delivery region 14 by means of cement or the like between the inner and outer surfaces of the forward end of delivery section 14 and the adjacent surfaces of the respective bands 17 and 19. Bands 26 and 27 extend from a position just behind the rim 17 along opposite sides of the fluid delivery region and the neck, to join the throat 11.

Figure 6:
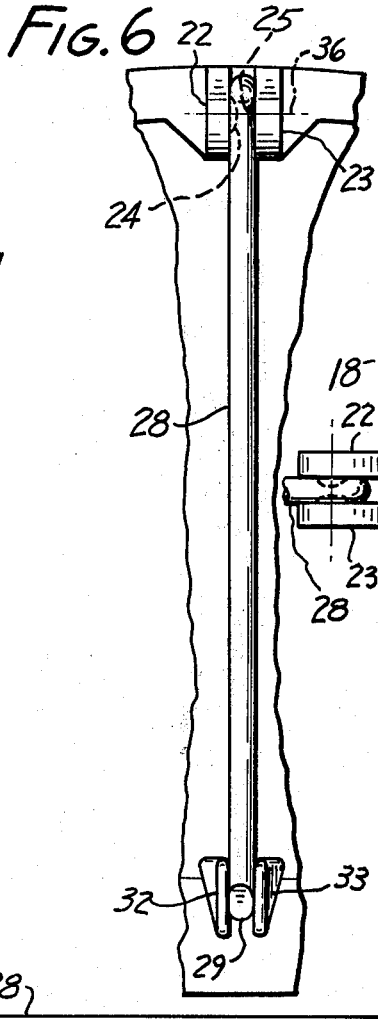
FIG. 6 is a bottom view of part of the nozzle of FIG. 1 showing the stick pin of FIG. 5 pivotally attached to the nozzle.
Figure 7:
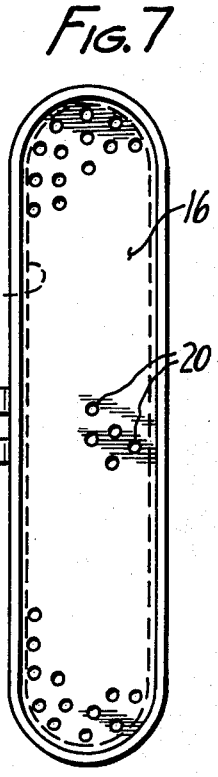
FIG. 7 is a view from line 7—7 of FIG. 1, looking into the spray face of the nozzle, the stick pin being in a pivotal position approximately, or near, perpendicular to the direction of spray of the fluid.
Figure 5:
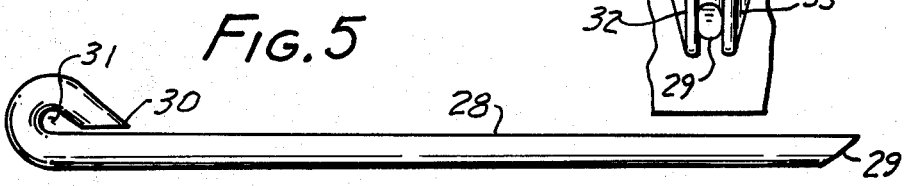
FIG. 5 shows a stick pin having an eye for attachment to the nozzle of FIG. 1.

A stick pin member 28 is pivotally attached to the lugs 22 and 23, as is best seen in FIGS. 6 and 7. For this purpose the pin is formed of a uniform cross section throughout its length except where it is brought to a point at each end 29 and 30, as best seen in FIG. 5. One end 30 of the pin is curled into a shape to form an open eye 31. The cross section of the pin is preferably circular as illustrated in FIGS. 5 and 6 and its diameter is such that the eye portion of the pin can be pushed into the space between the lugs 22 and 23 and past the raised bosses 24 and 25. This pushing of the eye applies lateral pressure against the bosses to spring the lugs away from each other while the pin material at the eye is passing the bosses. The dimension of the open eye relative to the bosses is such that when the pin is pushed into its position shown in FIGS. 6 and 7, parts of the bosses lie within the open eye permitting the lugs to spring back to their normal positions, in which the pin is held in pivotal relationship to the lugs by the bosses.

For the purpose of permitting the pin 28 to be held in a position along the bottom surface of the nozzle there is provided at the under side of the throat member 11 a pair of lugs 32 and 33 having a pair of opposed surfaces 34 and 35 respectively, spaced apart by an amount that permits entrance of the unpivoted end of the pin 28 by somewhat springing apart the surfaces 34 and 35 of the lugs and thus providing frictional holding of the end of the pin in this position as best seen in FIG. 6.

From the foregoing description it is seen that when the nozzle is not in use it may conveniently be disconnected from the conduit or hose to which it is intended to be connected and the stick pin can then be pivoted to the position shown in FIG. 6. When it is desired to use the nozzle it can be connected to the hose or conduit, and the end 29 of the pin 28 can be pulled out from between the lugs 32 and 33 and pivoted to a suitable position such as perpendicular, or nearly perpendicular, to the bottom of the nozzle as indicated in FIG. 7 so that the end 29 may be stuck into the ground and thus hold the front spraying part of the nozzle upward off the ground at some desirable angle, to spray water on lawn or flower beds or the like.

Figure 1:
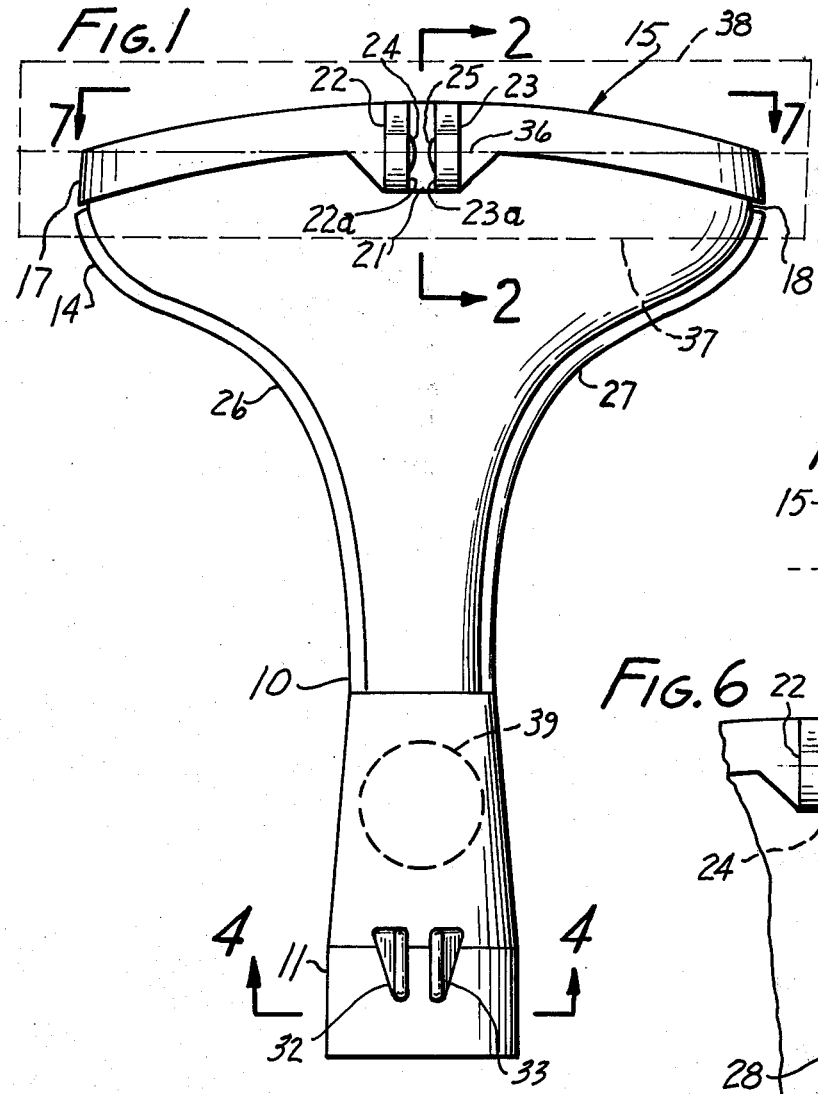
FIG. 1 is a bottom view of a fluid spray nozzle embodying this invention.

The dotted circle 39 shown in FIG. 1 does not represent any part of this invention. It merely is shown to represent the position, when present, of a rotatable hand-operated valve member having a circular periphery at the upper side of the throat. Such a valve, though not essential, is commonly present in spray devices. Such a valve member has a means for grasping it and also a shoe portion which rotates with rotation of the valve member so that in one position it shuts off the flow of fluid through the throat and in another position permits fluid to pass through the throat.

The nozzle may conveniently be made of a castable material which may be molded, such as polyvinyl chloride, which may be introduced into the mold in liquid form. It is desirable to make the nozzle in two molded parts, one of the parts containing the neck 10, throat 11 and fluid delivery section 14 and the lugs 32 and 33. The other part will comprise the spray member 15 with its lugs 22 and 23. The pin 28 is preferably of metal such as cadmium-plated steel wire of sufficient diameter to provide the desired strength and rigidity.

The molding of the part containing the neck, throat and delivery section presents no special problem and may be done in a well-known manner. The molding of the spray member 15 involves more of a problem because of the presence of the protruding bosses 24 and 25 at lugs 22 and 23. The preferred method of doing this according to this invention is to use a mold having two registering parts the abutting edges of which meet in a plane indicated by dot-dash line 36, at the position of the mold to be occupied by these lugs. The rectangle formed by line 36 and dotted line 37 in FIG. 1 indicates the position of one of the mold parts. The line 36 and dotted line 38 represent the position of the other of the mold parts. The plane 36 is selected to pass through the points of the bosses 24 and 25 which are closest to each other. These will be the centers of respective spheres which include the surfaces of the respective bosses where the bosses are made as portions of spherical surfaces. It is not necessary however that the bosses be parts of spheres. The important consideration is that the plane of separation of the mold members at the position of these lugs and bosses shall pass through the points of the bosses closest to each other. By so constructing the pair of mold members it is possible to remove the member 15 from the mold by separating the mold parts after the material being molded has cured to become solidifed in the mold. It will be recognized that apart from the bosses of the lugs, the member 15 presents no special problem in molding.

It will be understood that the embodiments of the invention illustrated and described herein are given by way of illustration and not of limitation, and that modifications or equivalents or alternatives within the scope of the invention may suggest themselves to those skilled in the art.

What is claimed is:

1. In a fluid spray nozzle comprising a neck which merges into an enlarged fluid delivery region, a spray member at the delivery part of said delivery region and a pivoted pin for insertion into the ground, the improvement comprising:

a pair of spaced lugs at the under side of said spray member, each of the lugs having a side wall, a rounded boss at each side wall said bosses-being, juxtaposed and protruding toward each other;

and a cylindrical stick pin having the form of an eye at one end, attached to the bosses, the thickness of the material of the eye being somewhat greater at its largest diameter than the normal minimum space between the bosses so that the attachment results from forcing the material of the pin at the eye, between the bosses to strain the bosses apart until the bosses become located at, and enter, the opening of the eye thereby holding the pin in pivoting relationship to the bosses.

2. The improvement according to claim 1 in which said spray member comprises two registering parts which are abutted and attached to each other, one of said registering parts being at the delivery end of the spray nozzle and the other registering part being rearward of said one part, there being a plane of demarcation between said two parts passing through points of said bosses which are closest to each other, whereby said parts may be made by molding.

* * * * *